US006263985B1

(12) United States Patent
Scheid et al.

(10) Patent No.: US 6,263,985 B1
(45) Date of Patent: Jul. 24, 2001

(54) DRILLING MACHINE WITH CHANGEABLE DRIVE UNIT

(75) Inventors: Winfreid Scheid, Ebersbach; Nikodemus Heinz, Albershausen, both of (DE)

(73) Assignee: Delmag Maschinenfabrik Reinhold Dornfeld GmbH & Co. (DE)

( * ) Notice: Subject to any disclaimer, the term of this patent is extended or adjusted under 35 U.S.C. 154(b) by 0 days.

(21) Appl. No.: 09/145,386

(22) Filed: Sep. 1, 1998

(30) Foreign Application Priority Data

Sep. 1, 1997 (DE) ..... 197 38 171

(51) Int. Cl.[7] ..... E21B 19/08

(52) U.S. Cl. ..... 175/162; 175/87; 175/122; 175/220; 173/29

(58) Field of Search ..... 175/87, 122, 162, 175/220; 173/29

(56) References Cited

U.S. PATENT DOCUMENTS 3,730,285 * 5/1973 Anderson et al. ..... 175/220
3,944,300 * 3/1976 Learmont et al. ..... 175/220 X
3,977,480 * 8/1976 Hilding ..... 175/122 X
4,096,608 * 6/1978 Lagerstedt ..... 175/220 X
4,190,119 * 2/1980 Loftis et al. ..... 173/149
4,309,922 * 1/1982 Beckley et al. ..... 81/57.16
4,570,706 * 2/1986 Pugnet ..... 175/162 X
5,036,927 * 8/1991 Willis ..... 175/162
5,058,688 * 10/1991 Scott et al. ..... 175/122 X
5,251,709 * 10/1993 Richardson ..... 175/220
5,348,430 * 9/1994 Metz et al. ..... 279/19 X
5,388,653 * 2/1995 England ..... 175/122
5,775,704 * 7/1998 Wilson et al. ..... 279/62

FOREIGN PATENT DOCUMENTS

19512109-A1 * 10/1996 (DE) .

* cited by examiner

*Primary Examiner*—David Bagnell
*Assistant Examiner*—Jong-Suk Lee

(57) ABSTRACT

A double-head drilling machine is disclosed, which by changing over or converting small component units can cooperate with drill or drill pipes of different diameters. To this end, drive carriages (16) operating on drills or drill pipes, for example, comprise a carriage base element (32), to which a drive unit (42) is releasably fitted. The drive unit (42) can thus be replaced by a different drive unit having essentially the same geometry, which is designed for operating with a drill or drill pipe having a different diameter.

12 Claims, 10 Drawing Sheets

DRILLING MACHINE WITH CHANGEABLE DRIVE UNIT

CROSS-REFERENCES TO RELATED APPLICATIONS

Not applicable.

STATEMENT REGARDING FEDERALLY SPONSORED RESEARCH OR DEVELOPMENT

Not applicable.

BACKGROUND OF THE INVENTION

1. Field of the Invention

The invention relates to a drilling machine according to the preamble of claim 1.

Known drilling machines of this type are designed for working with drills or drill pipes having a given diameter and are used successfully in large numbers in order to produce pile foundations for buildings.

2. Discussion of Relevant Art Including

Information Disclosed under 37 CFR 1.97–1.99.

For new buildings in already built-up areas of a locality, it has already been proposed (DE 195 12 109 A1) to construct the drive carriages on the drill or drill pipe so that they are particularly radially compact in the vicinity of their free end, so that a drill hole can be formed in the immediate vicinity of an existing building wall.

It would also be possible to make do with piles having reduced diameters in the immediate vicinity of already existing buildings for some applications in which it is unnecessary to provide a foundation which can be subjected to high loading. However, corresponding drilling machines have not been available to date. It would also be conceivable to generally design drilling machines for operation with drills and drill pipes having smaller diameters. However, only partial use would be made of drilling machines of this type, since a large proportion of foundation work which is to be carried out requires the piles having the larger diameters as used to date.

SUMMARY OF THE INVENTION

By way of the present invention, a drilling machine according to the preamble of claim 1 is therefore to be further developed in such a manner that it can be used equally with drills and/or drill pipes of different diameters.

This object is attained by way of a drilling machine having the features disclosed in claim 1.

Advantageous further developments of the invention are to be found in the subclaims.

In a drilling machine according to claim 2, the adaptation to the respective desired diameter of drill and/or drill pipe is effected in that a drive unit operating on the drill or drill pipe is replaced on the drive carriage. In this manner, it is not only the actual drive element which is changed, but also the drive, which consists of motor and reduction gearing. In this manner, the adjustment of the desired drill or drill pipe diameter is attained with a corresponding adaptation of the drive itself.

The further development of the invention according to claim 3 is advantageous in view of a simple and nevertheless precise fitting of the drive unit on the carriage body.

With the further development of the invention according to claim 4, it is attained that further auxiliary elements arranged on the drilling machine, such as tackle for moving loads, can be equally used irrespective of the current drill or drill pipe diameter setting of the drilling machine.

In a drilling machine according to claim 5, there is no need to fit any heavy parts in order to change from operating with a drill or drill pipe having a first diameter to operating with a drill or drill pipe having a second diameter. It is merely necessary to replace the drive element operating on the drill or drill pipe by another drill element.

Claim 6 discloses a particularly simple bearing for replaceable drive elements of this type.

In a drilling machine according to claim 7, it is automatically ensured that the cylindrical surface of the drill or drill pipe lying furthest from the fault finder remains essentially the same in the case of drill or drill pipes of different diameters. This makes it possible to produce drill holes for rows of piles of different diameters in front of an existing building wall by substantially identical movements of a chassis carrying the drilling machine. If the foundation work is carried out using numerical control of the chassis carrying the drilling machine, then it is unnecessary to fully reprogram the control when the drill or drill pipe diameter is changed; small changes to the program suffice.

In a drilling machine according to claim 8, a single movement allows for the adaptation of the bearing arrangement to the respective diameter of the drill or drill pipe and the engagement of a pinion of the drive unit with a drive toothed rim of the drive element operating on the drill or drill pipe.

The further development of the invention according to claim 9 is advantageous in view of good load uptake of the bearing arrangement.

In a drilling machine according to claim 10, a guide element adjacent the soil surface for drills or drill pipes can be easily adapted in its operating diameter.

BRIEF DESCRIPTION OF THE DRAWINGS

The invention will be explained in further detail in the following with the aid of embodiments with reference to the drawings. In the drawings.

DESCRIPTION OF PREFERRED EMBODIMENTS

Figure 1:
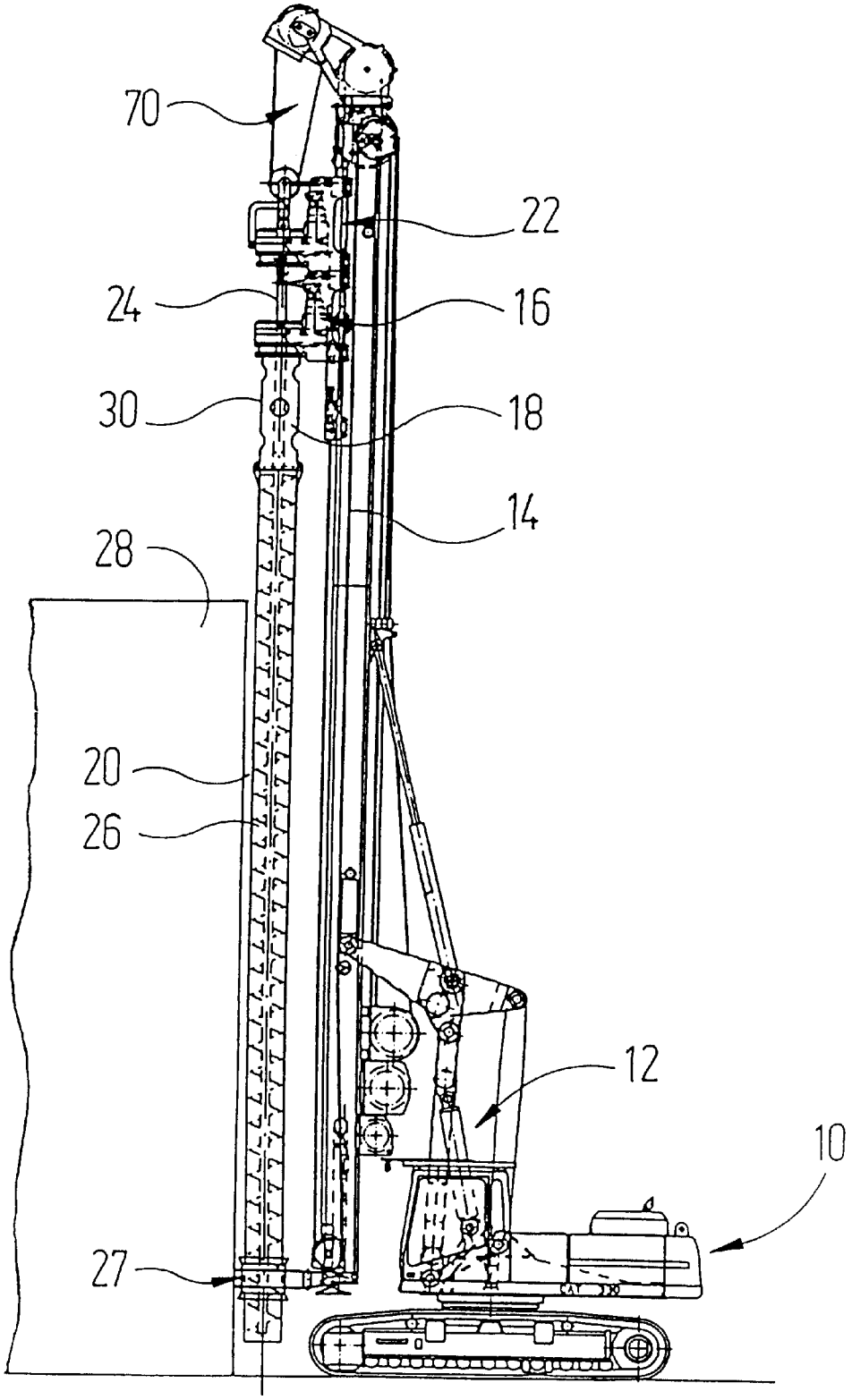
FIG. 1: is a side view of a double-head drilling machine for producing drill holes in the immediate vicinity of a building wall.

In FIG. 1, the reference 10 designates an excavator chassis in its entirety. The latter supports a fault finder 14, which is adjustable via a steering arrangement indicated in its entirety by the reference 12.

A drive carriage 16, which operates via a drive pipe 18 on a drill pipe 20, is displaceable in the vertical direction on the fault finder 14.

Lying above the drive carriage 16, a further drive carriage 22, which operates on a drive rod 24, is displaceable on the fault finder 14. The drive rod 24 supports a drill 26, which extends through the drill pipe 20.

Provided at the lower end of the fault finder is a pipe guide head 27, which forms a radial bearing for the drill pipe 20.

In order to produce a drill hole in the immediate vicinity of a schematically indicated building 28, the drill 26 is rotated and forced into the soil. According to the advance of the drill 26, the drill pipe 20 is also forced with rotation into the soil. The drill 26 constantly conveys the loosened soil upwards into the drill pipe 20, whence it can fall downwards via openings 30 in the drive pipe 18.

Once the drill 26 has reached the desired depth, it is withdrawn from the drill pipe by moving the drive carriage 22 upwards. If the pile which is to be produced is to be armoured, then an armouring is let down into the drill pipe 20, and the drill pipe 20 is then filled with local concrete and withdrawn rotating from the drill hole.

The procedure described above is repeated in such a manner that a row of adjacent local concrete piles is obtained, which can thus form a building foundation which lies in the immediate vicinity of the building 28.

Figure 2:
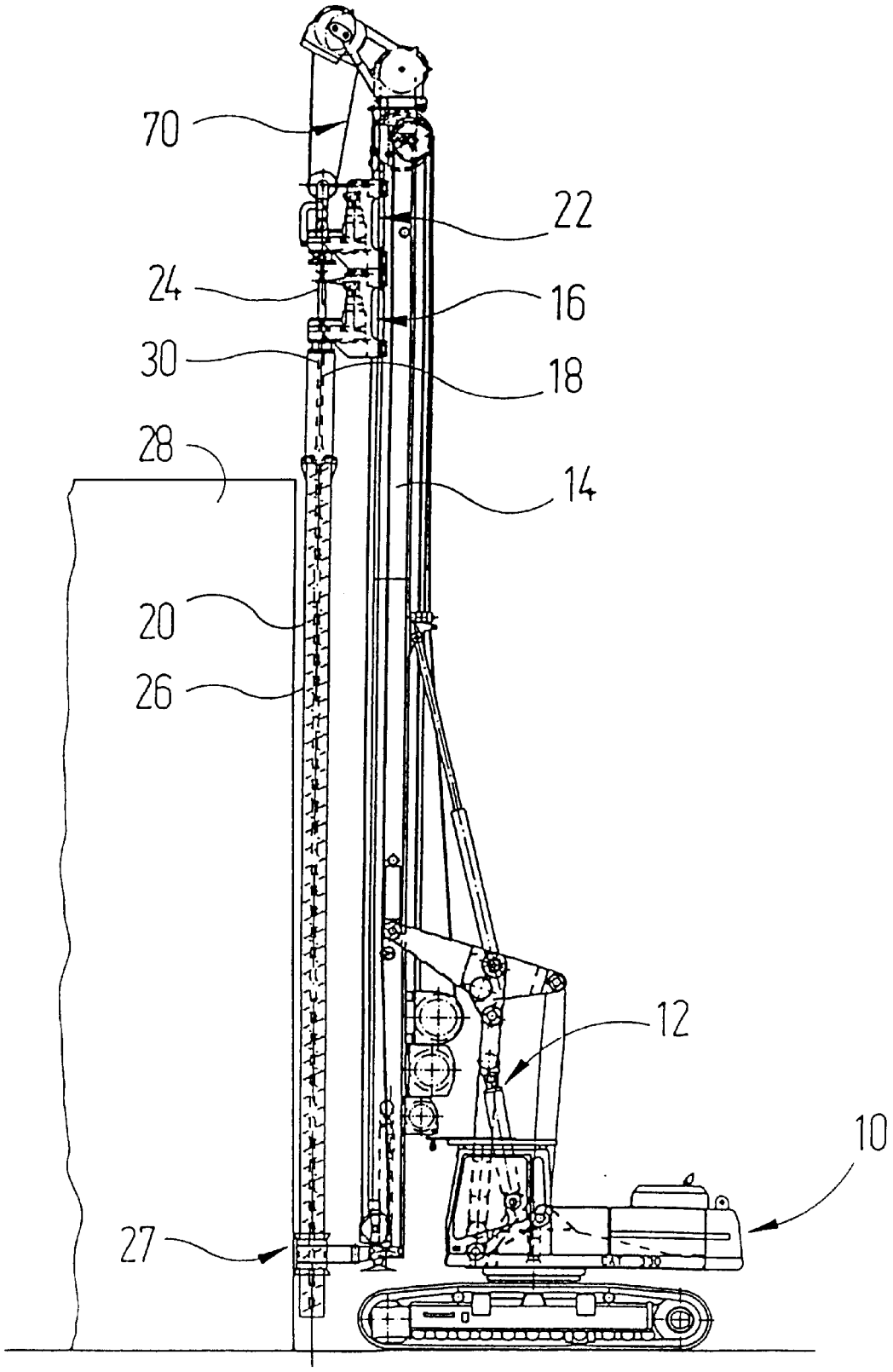
FIG. 2: is a similar view to FIG. 1, although in this case the drilling machine drives a drill having a smaller diameter and a drill pipe having a smaller diameter.

The drilling machine described above can be converted from operation with a drill pipe 20 having a large diameter and a drill 26 having a large diameter, as shown in FIG. 1, to operation with a drill pipe having a small diameter and a drill 26 having a small diameter, as illustrated in FIG. 2.

Figure 3:
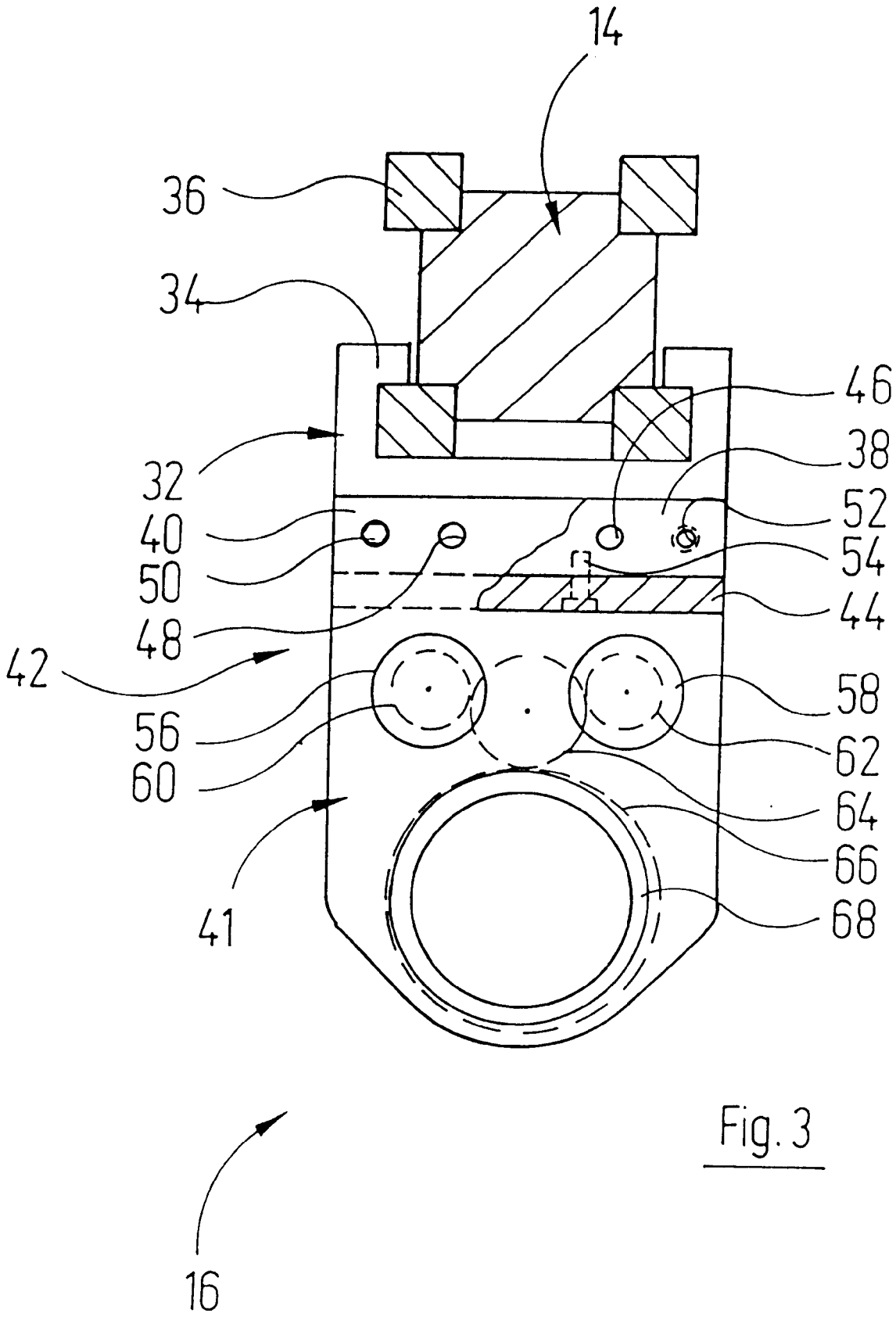
FIG. 3: is a top view of the drill pipe drive of the drilling machine according to FIG. 1, partially shown in section.
Figure 4:
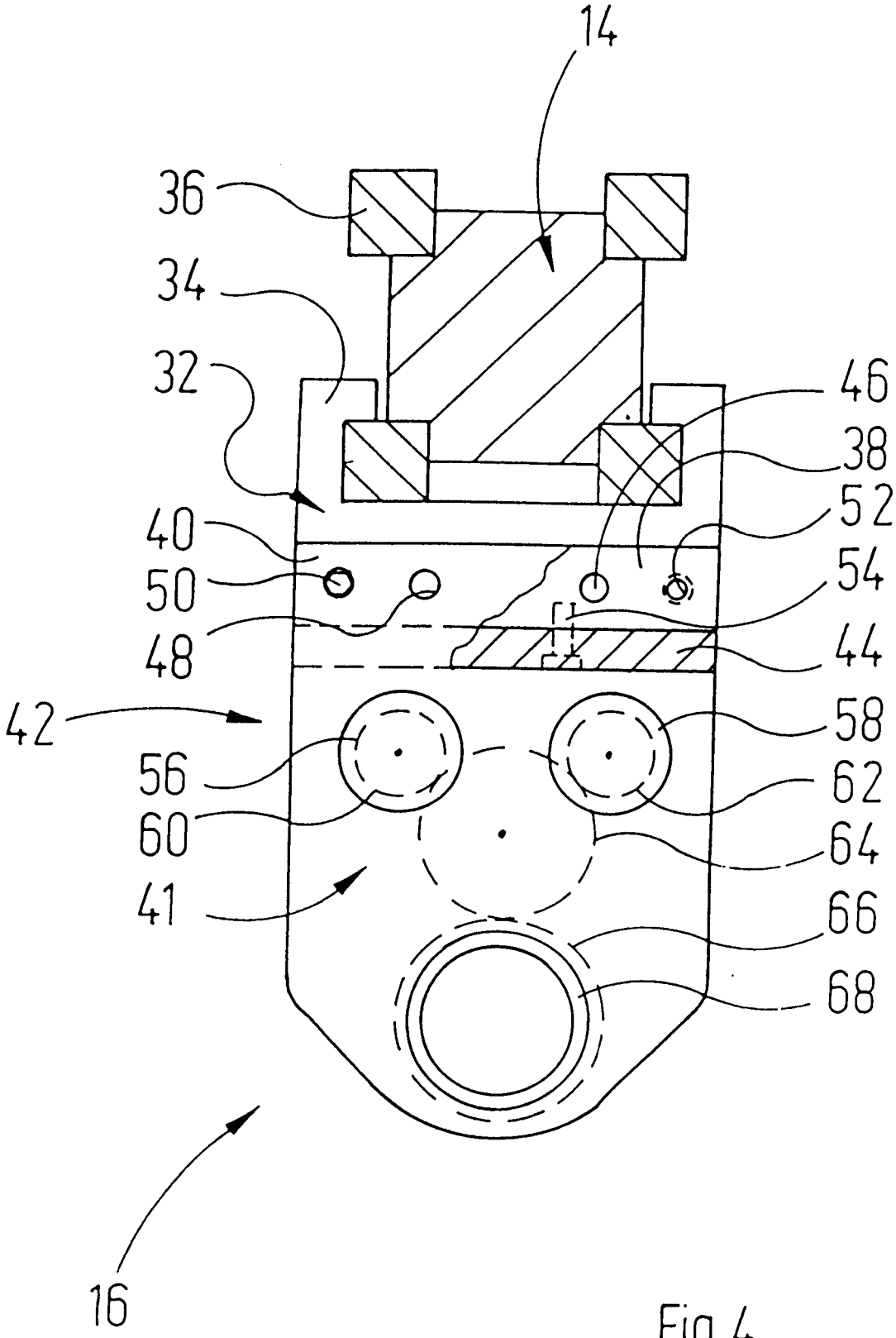
FIG. 4: is a top view of the drill pipe drive of the drilling machine according to FIG. 2, partially shown in section.

In order to carry out this conversion simply, the drive carriages 16 and 22 each have the construction shown in FIGS. 3 and 4, these drawings showing the drive carriages for the drill pipe, the drive carriages for the drill and the pipe guide head being similarly designed.

As a modification, the upper drive carriage 22 can be constructed in such a manner that it is suitable for use together with the drill having the smallest diameter, the drive rods for the drills having larger diameters remaining the same in this case.

As shown in FIG. 3, the drive carriage 16 has a carriage base element 32, which with lateral cheeks 34 engages around guide strips 36, which are provided in the corners of the fault finder 14. Resting on a shoulder 38 of the carriage base element 32 is a rear end section 40 of a box frame 41 of a drive unit designated in its entirety by the numeral 42. The latter has a downwardly hanging plate 44, which rests against the front side of the carriage base element 32.

Provided on the shoulder 38 are positioning rods 46, which cooperate with positioning apertures 48, which are provided in the end section 40 of the drive unit 42. Screws 50, which cooperate with threaded bores 52 in the shoulder 38, are used for the releasable connection of the drive unit 42 with the carriage base element 32. Further screws 54 extend through the vertical plate 44 and are screwed into the front boundary surface of the carriage base element 32.

The drive unit 42 supports two hydromotors 56, 58, which operate via pinions 60, 62 on an intermediate pinion 64. The latter meshes with a toothed rim 66, which is constructed on the outer surface of a drive sleeve 68, and this is mounted via a radial/axial bearing, not shown in further detail in FIG. 3, in the front section of the drive unit 42. In this respect, the thickness of the drive sleeve 68 and the web of the box frame 41 of the drive unit 42 enclosing the drive sleeve 68 are selected to be as small as is still acceptable in respect of the mechanical loading. In this manner, the drive unit 42 projects only slightly in the radial direction beyond the outer surface of a drill pipe 20 connected to the drive sleeve 68, as is shown in FIGS. 1 and 2.

The drive carriage 22 for the drill is similarly constructed, with the exception that a drive disc is provided instead of the drive sleeve 68, the drive disc comprising in its centre a polygonal (usually square) opening for a drill rod.

The pipe guide head 27 is also constructed similar to the drive carriage 16, but comprises a radial bearing unit, which can be removed from the carriage base element and cooperates with the outer surface of the drill pipe.

If it is intended to convert the drilling machine to operation with drills having a smaller diameter and drill pipes having a smaller diameter, then the screws 50 and 54 are released and with the aid of a lifting tool schematically indicated 70 in FIGS. 1 and 2, the drive unit 42 of the drive carriage 22 and then the drive carriage 16 are raised and placed onto the ground. The radial bearing unit of the pipe guide head 27 is then removed. A new radial bearing unit and new drive units 72 are then accommodated and again secured in reverse sequence to the carriage base elements 32 of the pipe guide head 27, the drive carriage 16 and the drive carriage 22. The new radial bearing unit and the new drive units have the same geometry as the replaced units with the proviso that they are designed for different diameters of drill or drill pipe. For example, if the drive sleeve 68 now has the desired smaller diameter on the drive carriage 16, then the size of the intermediate pinion 64 is accordingly increased.

Since drills and drill pipes having smaller diameters can be rotated into the soil with reduced torque, it is also possible to provide smaller hydromotors 56, 58.

It can be seen that a drilling machine as described above can be very rapidly converted for the drilling of drill holes of different diameters.

Figure 5:
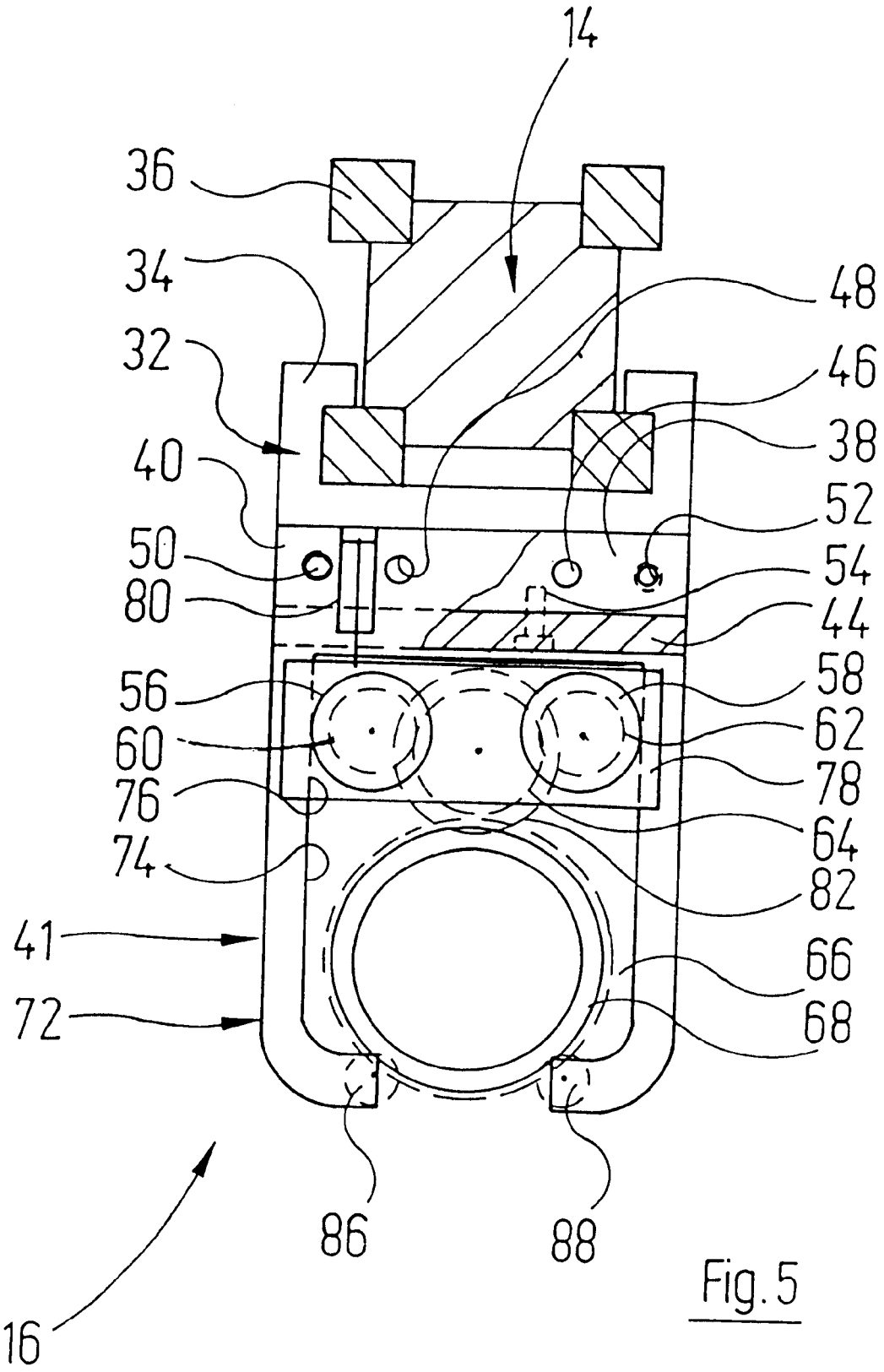
FIG. 5: is a top view of a modified drill pipe drive in the setting for drill pipes having large diameters.
Figure 6:
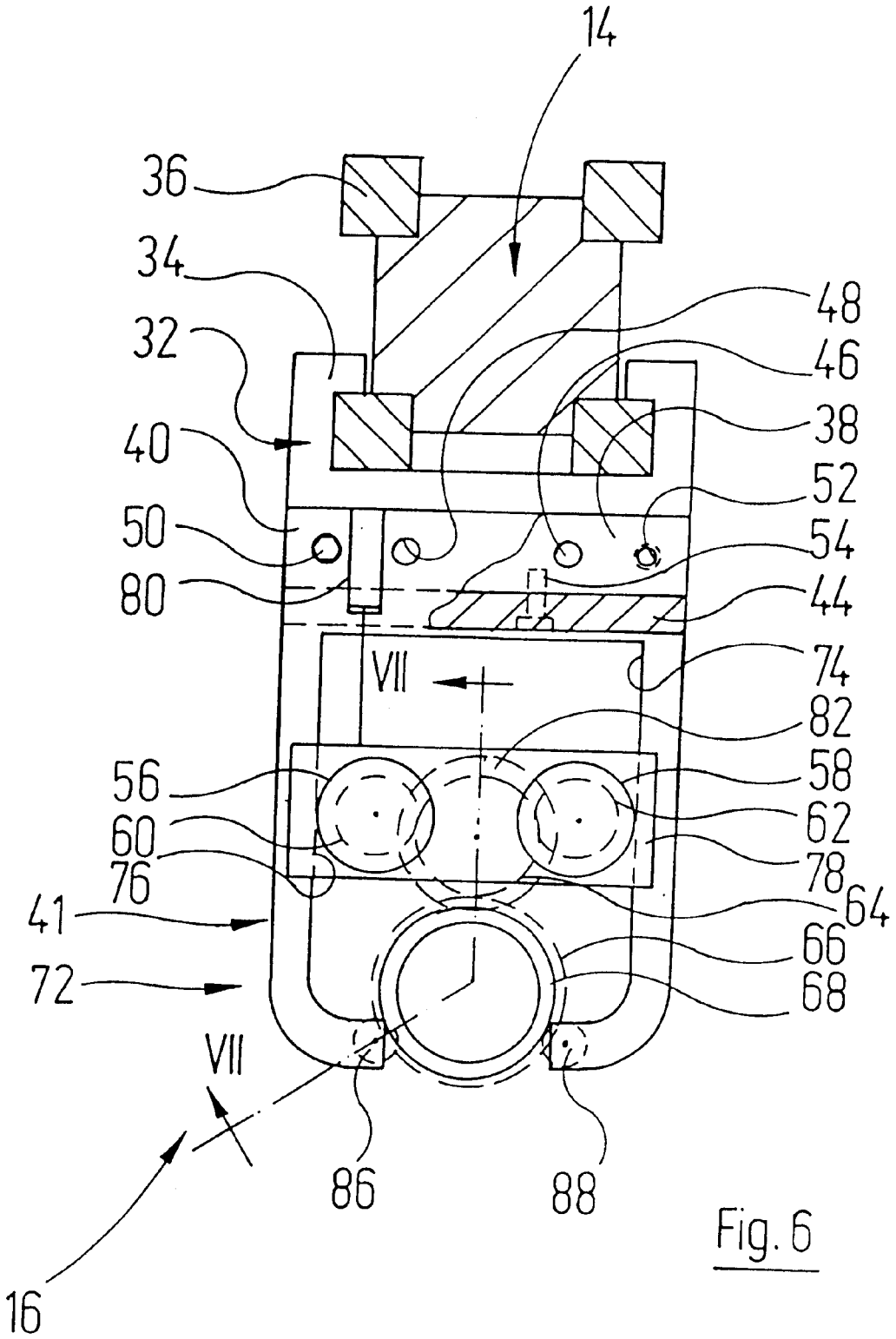
FIG. 6: is a similar view to FIG. 5, although in this case the drill pipe drive is adjusted for a drill pipe with a small diameter.

In the embodiment illustrated in FIGS. 5 and 6, parts of the drive carriage which correspond in their function to parts already explained with reference to FIGS. 3 and 4 are again provided with the same reference numerals. These parts are not described again in detail in the following.

In this case, an upper plate of the box frame 41 of the drive unit 42 has a rectangular opening 74. The edges of the opening 74 extending towards the free ends of the drive unit simultaneously act as guide rails for guide grooves 76, which are provided in lateral surfaces of a motor plate 78. The motor plate 78 supports the hydromotors 56, 58 as well as the intermediate pinion 64. In order to move the motor plate 78 in a horizontal direction perpendicular to the fault finder, two hydraulic cylinders 80 are used, which are supported against the rear end section 40 of the housing 41 of the drive unit 42.

The intermediate pinion 64 has a bearing collar 82, which lies beneath the toothed rim of the intermediate pinion, projects radially beyond the pinion toothed rim 66 and runs axially beneath the pinions 60, 62. The bearing collar 82 has a trapezoidal cross section. A bearing groove 84, which has a cross section matching the bearing collar 82, is cut into the drive sleeve 68 beneath the toothed rim 66.

In the case of the free end of the drive unit 72, bearing rollers 86, 88 having small diameters are mounted, whose contour also matches the bearing groove 84. The drive sleeve 68 is thus mounted by the intermediate pinion 64 with its bearing collar 82 and the bearing rollers 86, 88.

By moving the motor plate 78 in the direction of the fault finder 14, the bearing collar 82 can be moved away from the drive sleeve 68 to such an extent that the latter is released from the bearing rollers 86, 88 and can be removed from the box frame 41. A drive sleeve 68 having a smaller diameter can then be inserted and the motor plate 78 can be moved away from the fault finder to such an extent that the bearing sleeve 68 simultaneously engages again with the bearing collar 82 and the bearing rollers 86 and 88. A correct engagement between the toothed rim of the intermediate pinion 64 and the toothed rum 66 of the drive sleeve 68 is then simultaneously produced, since all drive sleeves which are to be used together with the drive carriage comprise toothed rims consisting of teeth having the same shape.

Figure 7:
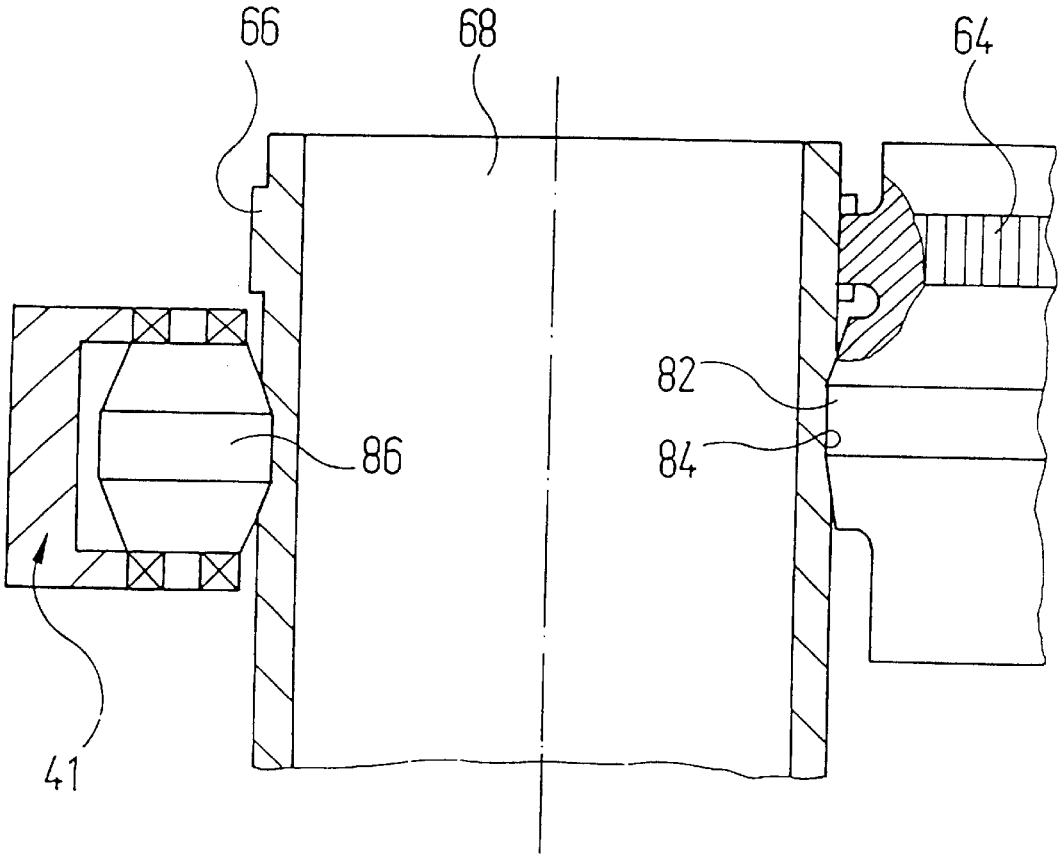
FIG. 7: is an axial section through the drill pipe drive of FIG. 7 taken along the line of section VII—VII in FIG. 7, FIGS. 8 and 9: are views similar to FIG. 6, although in these cases a modified drill pipe drive is again shown.

The engagement relationships between the intermediate pinion 64 and the bearing rollers 86, 88 on the one hand and the drive sleeve 68 on the other hand can be clearly seen from the angled sectional view of FIG. 7.

Figure 8:
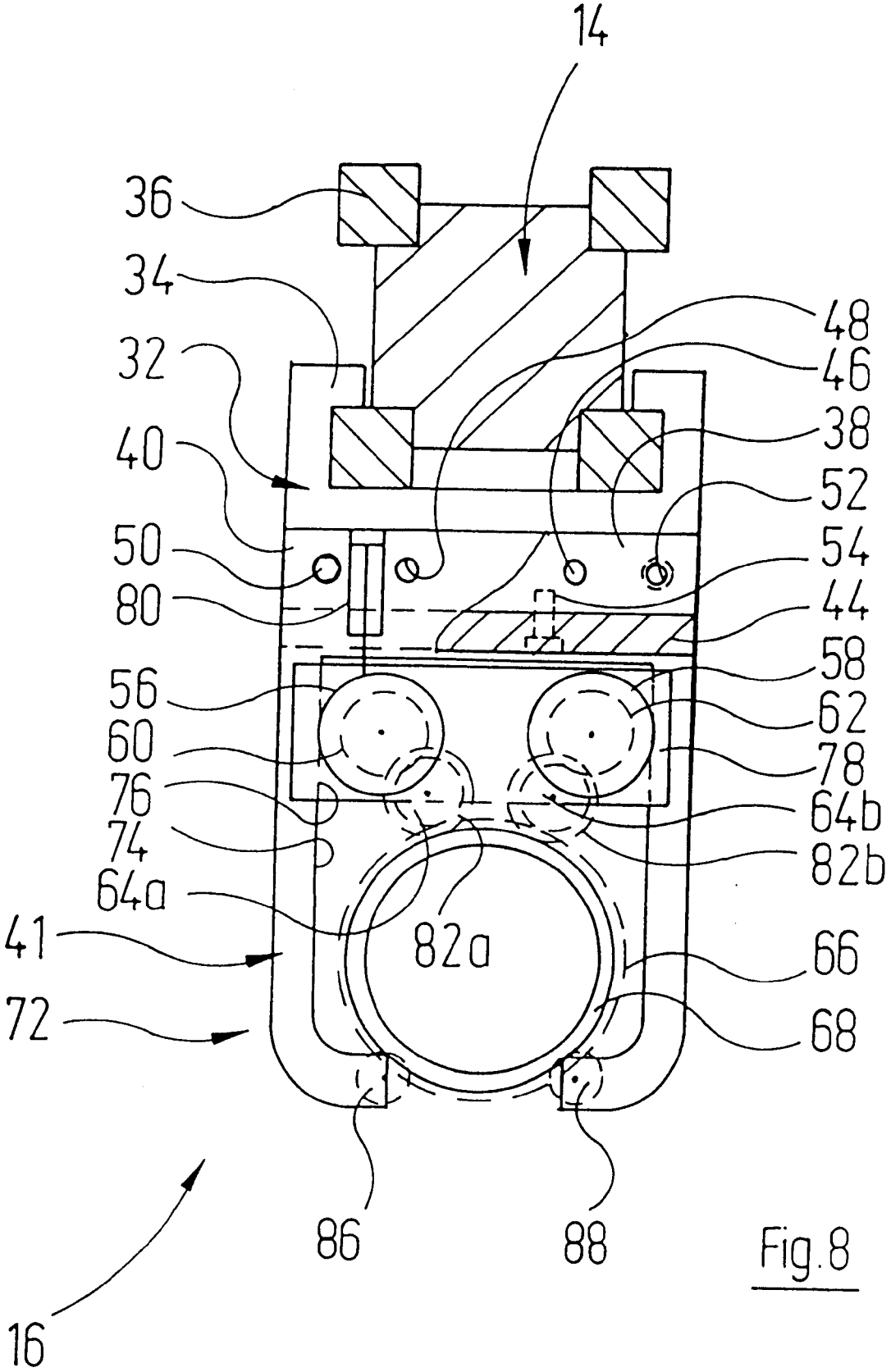

The further modified embodiment according to FIG. 8 differs from that according to FIG. 7 only in that two intermediate pinions 64*a* and 64*b* are used instead of a single intermediate pinion 64, the two intermediate pinions being arranged symmetrical to the vertical centre plane of the drive carriage 16 in FIG. 8.

Figure 9:
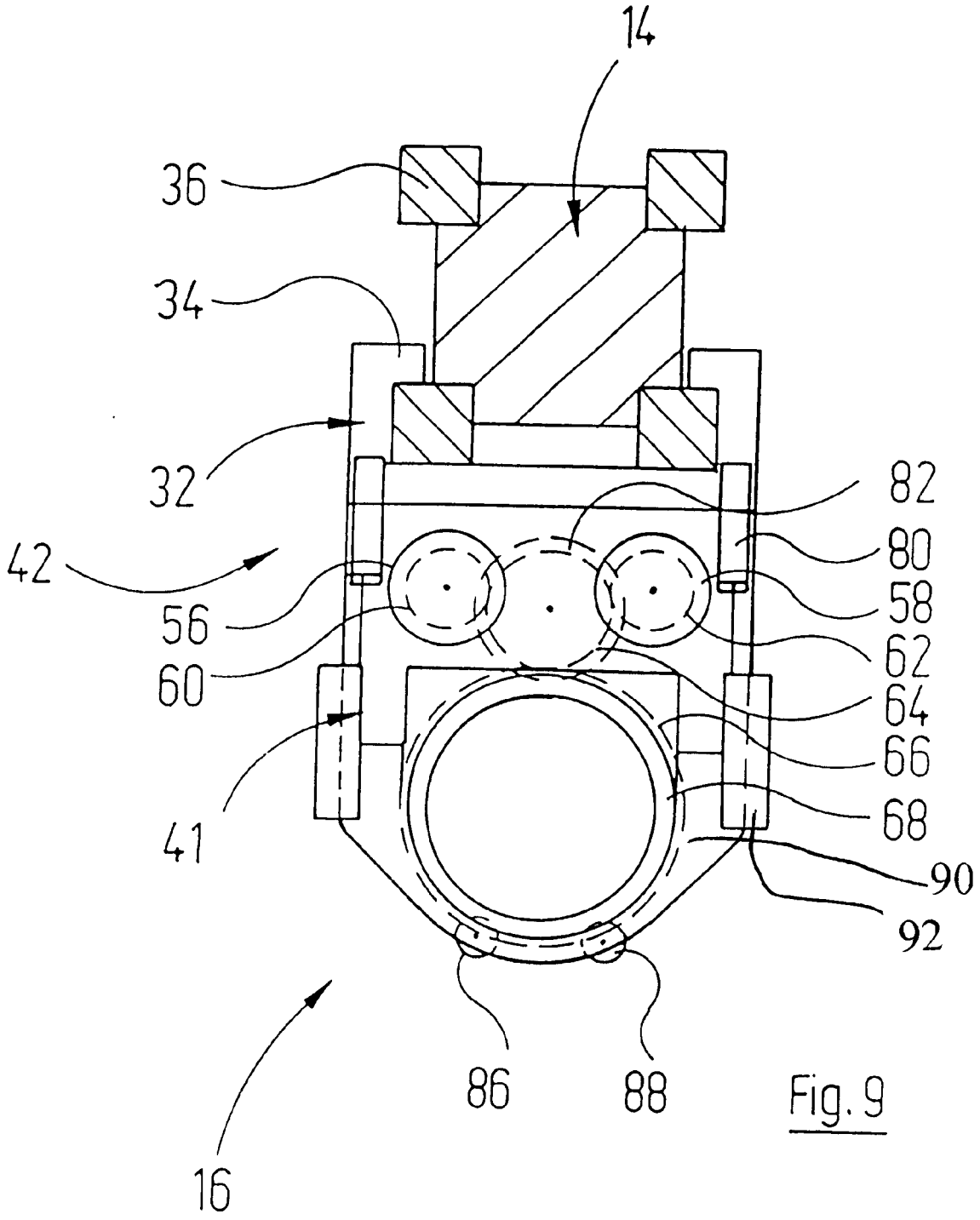

In the embodiment according to FIG. 9, the bearing rollers 86, 88 are supported by a bearing plate 90, which with guide shoes 92 engages over the lateral edges of the box frame 41. The bearing plate 90 is adjustable and lockable by hydraulic cylinders 80. Also in this manner, the drive carriages 16 can bear and drive drill pipes having different diameters.

It is, of course, also possible to use sliding bearing elements instead of the bearing rollers 86, 88 shown in FIGS. 5 to 9, the sliding bearing elements cooperating with the bearing groove 84 and only extending over a small circumferential region, so that they can cooperate equally well with circular bearing grooves of different diameters.

Figure 10:
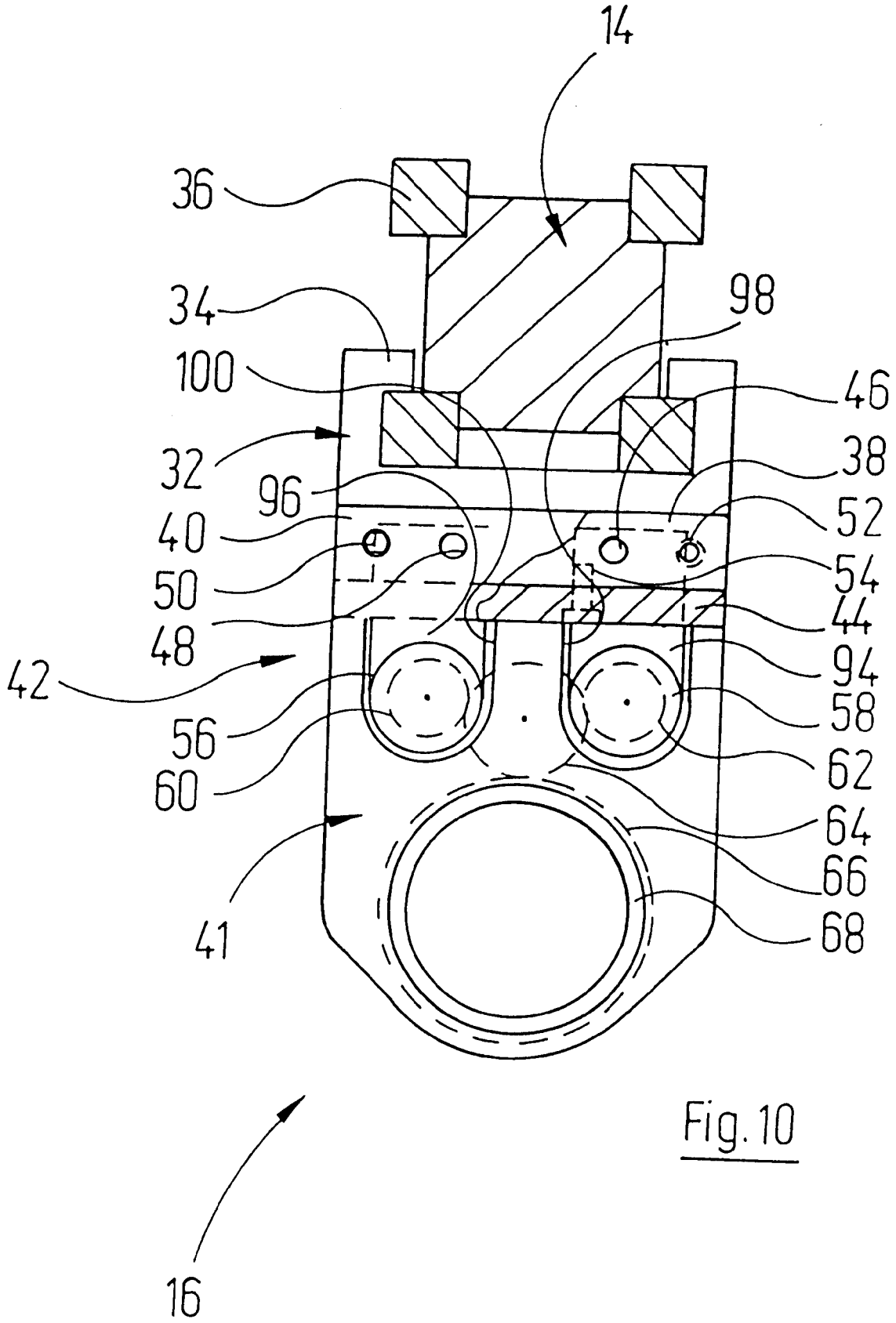
FIG. 10: is a similar view to FIG. 3, although in this case a modified drill pipe drive is again reproduced.

In the case of the drive carriage according to FIG. 10, the hydromotors 56, 58 are fitted to support plates 94, 96, which are fitted to the carriage base element 32 independent of the housing 41 and are accommodated in recesses 98, 100 in the housing 41. The adaptation of the drive carriage to the respective drill pipe diameter is effected merely by exchanging the bearing and gearing unit, which is formed by the components 41, 64, 66, 68. In this manner, the unit which is to be replaced is cheaper, and the connections to the hydromotors do not need to be released in order to convert the drill pipe diameter.

What is claimed is:

1. A drilling machine comprising:

a leader (14), at least one drive carriage (16; 22) that is displaceable on said leader (14) and cooperates with a drill element (20; 26), wherein said drive carriage (16; 22) is adjustable to drill elements (20; 26) of different diameters and comprises a carriage base element (32) that is displaceable on said leader (14), and a driving unit (42) releasably secured to said carriage base element (32), said driving unit being in driving engagement with said drill (42) element (32), said driving unit (42) being selected from a set of driving units that are adapted to cooperate with said drill elements (20; 26) of different diameters such that said driving units (42) are radially compact in the vicinity of a free end portion thereof and said free and portion projects only slightly beyond an outer surface of said drill elements (20, 26).

2. A drilling machine as claimed in claim 1, wherein the driving unit (42) is positioned on the carriage base element (32) by means of positioning means (46, 48).

3. A drilling machine as claimed in claim 1, wherein said set of driving units (42) have the same geometry with the proviso that said set of driving units are designed for said drill elements (20, 26) of different diameters.

4. A drilling machine as claimed in claim 1, wherein the drive carriage (16; 22) comprises a detachable or convertible bearing arrangement (82 to 88), and a motor unit (56, 58, 78) is displaceably arranged on the drive carriage (16; 22) in a direction radial to the axis of the drill element, and toothed rims (66) of drive elements (68) operating on said drill elements of different diameters are constructed from teeth having the same contour.

5. A drilling machine as claimed in claim 4, wherein the bearing arrangement comprises a plurality of bearing rollers (82, 86, 88) which engage in a bearing groove (84) in the drive element (68), at least one of the bearing rollers (82, 86, 88) being displaceable in a radial direction relative to the axis of the drive element (68).

6. A drilling machine as claimed in claim 5, wherein the bearing arrangement comprises two stationary bearing rollers (86, 88), which are adjacent the end of the drive carriage (16, 22) remote from the leader (14), the stationary bearing rollers being arranged symmetrical to a center plane of the drive carriage (16; 22) passing through the axis of the drive element (68).

7. A drilling machine as claimed in claim 6, wherein the bearing arrangement comprises at least one displaceable bearing roller (82, 82*a*,82*b*).

8. A drilling machine as claimed in claim 5, wherein the bearing rollers (82, 86, 88) are conical-shaped rollers and run in the bearing groove (84) in the drive element (68), which has a matching, complementary cross section.

9. A drilling machine as claimed in claim 1, wherein said driving unit comprises a releasable part of a drive assembly.

10. A drilling machine as claimed in claim 9, wherein said driving unit comprises a radial bearing and gearing unit.

11. A drilling machine as claimed in claim 10, wherein said radial bearing and gearing unit is releasably secured to said carriage base element (32).

12. A drilling machine comprising:

a leader (14), at least one drive carriage (16; 22) that is displaceable on said leader (14) and cooperates with a drill element (20; 26), wherein said drive carriage (16; 22) is adjustable to drill elements (20; 26) of different diameters and comprises a carriage base element (32) that is displaceable on said leader (14), and a driving unit (42) releasably secured to said carriage base element (32), said driving unit (42) being in driving engagement with said drill element (20; 26), said driving unit (42) being selected from a set of driving units that are adapted to cooperate with said drill elements (20; 26) of different diameters such that said driving units (42) are radially compact in the vicinity of a free end portion thereof and said free and portion projects only slightly beyond an outer surface of said drill elements (20; 26), wherein said set of driving units (42) have the same geometry, with the proviso that said set of driving units are designed for said drill elements (20; 26) of different diameters.

* * * * *